US006216416B1

(12) United States Patent
West et al.

(10) Patent No.: US 6,216,416 B1
(45) Date of Patent: Apr. 17, 2001

(54) METAL ROOF INSTALLATION SYSTEM

(76) Inventors: William D. West, 785 Clell West Rd.; Timothy D. West, 356 Clell West Rd.; Charles M. West, 735 Clell West Rd.; Michael M. West, 737 Clell West Rd.; Gary M. West, 562 Clell West Rd., all of Helenwood, TN (US) 37755

( * ) Notice: Subject to any disclaimer, the term of this patent is extended or adjusted under 35 U.S.C. 154(b) by 0 days.

(21) Appl. No.: 09/305,825

(22) Filed: May 5, 1999

(51) Int. Cl.[7] ..... E04D 15/00; E04G 21/16

(52) U.S. Cl. ..... 52/749.12; 52/745.06; 414/11

(58) Field of Search ..... 52/745.06, 745.13, 52/748.1, 748.11, 749.12; 193/37; 414/11, 572, 679, 749.1

(56) References Cited

U.S. PATENT DOCUMENTS 3,769,916 * 11/1973 Hogan ..... 52/749.12 X
3,983,676 * 10/1976 Gilpin ..... 52/749.12
4,068,446 * 1/1978 Brueske ..... 52/746.11
4,222,212 * 9/1980 Alderman ..... 52/749.12
4,864,837 * 9/1989 Fielden, Jr. ..... 52/749.12 X
4,967,535 * 11/1990 Alderman ..... 52/749.12
5,251,415 * 10/1993 Van Auken et al. ..... 52/745.06 X
5,491,952 * 2/1996 Alderman et al. ..... 52/749.12
5,495,698 * 3/1996 Alderman et al. ..... 52/745.06 X
5,551,203 * 9/1996 Alderman et al. ..... 52/749.12 X
5,561,959 10/1996 Alderman et al. .
5,653,081 * 8/1997 Wenrick et al. ..... 52/749.12 X
5,653,083 * 8/1997 Alderman et al. ..... 52/749.12
5,664,740 * 9/1997 Alderman et al. ..... 52/749.12 X
5,685,123 * 11/1997 Alderman et al. ..... 52/749.12
5,720,147 * 2/1998 Wenrick et al. ..... 52/745.06
5,884,449 * 3/1999 Alderman et al. ..... 52/749.12 X
5,911,385 * 6/1999 Neifer et al. ..... 52/749.12 X
5,921,057 * 7/1999 Alderman et al. ..... 52/749.12 X
5,946,804 * 9/1999 Alderman ..... 52/749.12 X
6,003,282 * 12/1999 Alderman et al. ..... 52/745.13 X
6,023,904 * 2/2000 Alderman ..... 52/749.12 X
6,041,568 * 3/2000 Alderman et al. ..... 52/749.12
6,056,231 * 5/2000 Neifer et al. ..... 52/749.12 X
6,101,782 * 8/2000 Abney et al. ..... 52/749.12

* cited by examiner

*Primary Examiner*—Carl D. Friedman
*Assistant Examiner*—Kevin D. Wilkens
(74) *Attorney, Agent, or Firm*—Pitts & Brittian, PC

(57) ABSTRACT

A system for installing a metal roof system including an insulation layer placed over a series of purlins and under a metal deck while preventing workers from falling through the insulation. The system is primarily comprised of a material handling assembly and a working deck. The material handling assembly includes at least one conveyor segment positioned across the purlin. Each conveyor segment is comprised of a rectangular frame in which is disposed a series of rollers. The rollers are disposed in parallel fashion relative to each other and in a lateral direction with respect to the frame. A roller assembly is secured to the conveyor segments at each purlin in order to accomplish lateral movement of the system as the roof installation process progresses. At least one winch is mounted to the material handling assembly, from which is extended a winch cable. The winch cable is secured to the far end of the building. The working deck is secured along a leading edge to each roller assembly and is fabricated from a corrugated metal such as to withstand the weight of several roofers, as well as materials and other equipment necessary to the installation of a metal roof system. A safety cable is provided on the leading edge of the material handling assembly to serve as a fall barrier. After a sufficient number of roof panels have been secured to the purlin, a retractable handrail and skid assembly is employed on each end of the trailing edge of the roof in order to provide a fall barrier for workers employed on the roof.

20 Claims, 7 Drawing Sheets

METAL ROOF INSTALLATION SYSTEM

TECHNICAL FIELD

This invention relates to the field of metal roofs. More specifically, the present invention relates to a system for safely installing a metal roof on a structure by providing a continuous walking support for workers performing the installation.

BACKGROUND ART

In the field of roofing, and especially in the field of installing metal roofing, it is well known that safety issues are of great concern. Metal roof systems are well known in the art, as are their methods of installation. Each different roof system requires particular steps in connecting individual roofing panels to each other and to roof trusses. However, all metal roof systems have many basic similarities. For example, it is well known that a metal roof construction includes a number of roof trusses disposed in parallel fashion, and at progressively increasing elevations to define a slope. The slope may be defined either from one side of the roof to the other, or from both sides of the roof toward the center, depending upon the particular structure. Roof trusses in conventional roofs may be any conventional material and configuration.

Roof panels are then laid across the roof trusses in the direction of the slope, and at a right angle with respect to the direction of the roof trusses. The individual roof panels are placed from the bottom of the slope to the top, with each successive panel overlapping the last in order to prevent moisture from seeping between. A sealant may be used to further effect a moisture-tight seal. Adjacent roof panels are typically provided with an engagement mechanism to secure the panels together in a sealed disposition After the roof panels are positioned as desired, they are fastened to the roof trusses. However, it is common to position a layer of insulation on top of the roof trusses prior to placing and securing the roof panels. Thus, after the insulation is in place, and before the roof panels are positioned, the insulation is merely laying on the roof trusses. Because there is typically no decking between the insulation and the roof trusses, the insulation provides no support for carrying a load.

Due to the placement of the insulation, there have been roof installers who have had a false sense of security in the insulation and, without thinking, have placed all of their weight on the insulation and have thus fallen through to the ground. If there is nothing between the insulation and the ground to break their fall, they will fall on what is typically a concrete floor, thus causing extensive physical damage, and in some cases, death. Accordingly, in an environment such as the installation of a metal roof in the manner described, safety precautions are required.

Other systems have been developed to assist in the installation of a metal roof as described. Typical of the art are those described in U.S. Pat. Nos. 5,551,203 and 5,561,959, both issued to R. J. Alderman, et al. As described by the assignee of these patents, Owens Corning, the system described in the '203 and '959 patents, marketed by Owens Corning as at the "Elaminator System", is designed to provide safety solutions for laminators and builders, as well as cost- and time-effective methods to improve thermal performance. The '203/'959 system includes a carriage which is urged along the purlins of the roof structure. A roll of insulation is mounted to the carriage and dispenses a substantially continuous sheet of blanket insulation material over the purlins as the carriage is progressively moved along the length of the purlins. A radiant barrier dispenser dispenses a layer of radiant barrier material over the dispensed blanket insulation material and a cross-wise layer of insulation is applied across the length of the purlins in a direction normal to the direction of application of the blanket insulation material. Thereafter, sheets of hard metal roofing material are attached to the purlins over the cross insulation to form the insulated roof structure. The radiant barrier material is configured to be received between the purlins, and cannot provide a load bearing surface. Specifically, the '203/'959 system does not provide for the safety of a roofer who may place his weight on the insulation layer, whether intentionally or by accident.

An improvement to the '203/'959 system is the "PERFECT R system marketed by CGI/Silvercote, Inc. The PERFECT R insulation system is provided for applying metal building insulation to pre-engineered buildings using a vapor retarder machine which attaches the facing to the top of the roof purlins, trusses or joists. The PERFECT R insulation system, as described by CGI/Silvercote, is designed to provide a cleaner appearance on the interior of metal buildings and to fiicilitate speed and ease during the installation of insulation, as compared to the '203/'959 system described above. The PERFECT R insulation system includes two tape dispensers that apply two-sided tape to the facing as the machines are manually advanced down the length of the building by a push rod. The machines simultaneously dispense and position the facing to a preset depth as they are moved. However, the PERFECT R insulation system does not include a means for supporting the weight of a worker on the insulation. Specifically, the system is described as providing a finished roof area from which to work, once the first roof panels are installed. Further, the PERFECT R insulation system, while claiming to provide a safer work environment, specifically disclaims the use thereof as a fall protection device. One device that is provided as a fall protection device is that disclosed by R. H. Van Auken, et. al., in U.S. Pat. No. 5,251,415. The '415 device is a nonmetallic mesh that is stretched across the entire area of the roof and secured at the periphery of the roof The mesh is placed loosely over the purlins in order to accommodate the placement of insulation. The mesh has sufficient strength to protect workers installing the roof in the event of an accident. However, the '415 device does not provide a surface on which the workers may walk during installation of the roof Further, due to the nature of the mesh material, while workers may be prevented from falling as a result of an accident, it does not prevent items such as tools, nails, and the like from falling through the openings in the mesh. Further, because the mesh is placed permanently as a component of the roof system, it may not be removed and reused, thus elevating the cost of installing the roof system.

Therefore, it is an object of this invention to provide a system for installing a metal roof system including an insulation layer placed over a series of purlins and under a metal deck while also providing a means for preventing workers from falling through the insulation. Another object of the present invention is to provide such a system whereby a working deck is provided for supporting insulation prior to securement of a section of metal decking.

Still another object of the present invention is to provide such a system whereby the working deck is moved along the purlins as the roof is being installed.

Yet another object of the present invention is to provide such a system whereby a material handling device is provided proximate the working deck such that time and energy dedicated to moving metal roofing materials is greatly reduced when compared to conventional alternatives.

DISCLOSURE OF THE INVENTION

Other objects and advantages will be accomplished by the present invention which is provided for installing a metal roof system including an insulation layer placed over a series of purlins and under a metal deck while also providing a means for preventing workers from falling through the insulation. The system is primarily comprised of a material handling assembly and a working deck. The working deck is mounted along one side to the material handling assembly. Each of the material handling assembly and the working deck of the preferred embodiment is configured to extend the entire length of the roof.

The material handling assembly includes at least one conveyor segment positioned across the purlins. Each conveyor segment is comprised of a rectangular flame in which is disposed a series of rollers. The rollers are disposed in parallel fashion relative to each other and in a lateral direction with respect to the frame. A roller assembly is secured to the conveyor segments at each purlin in order to accomplish lateral movement of the system as the roof installation process progresses. At least one winch is mounted to the material handling assembly. A winch cable is extended from each winch and secured to the far end of the building. When it is desired to move the system toward the far end of the building in order to secure a roof panel, each winch is actuated to retract the winch cable.

The working deck is secured along a leading edge to each roller assembly using conventional bolts. The working deck is fabricated from a corrugated metal such as to withstand the weight of several roofers, as well as materials and other equipment necessary to the installation of a metal roof system.

A safety cable or hand rail is provided on the leading edge of the material handling assembly to serve as a fall barrier. The safety cable is tautly stretched between each of two end frames, and supported by at least one intermediate support. After a sufficient number of roof panels have been secured to the purlins, a retractable handrail and skid assembly is employed on each end of the trailing edge of the roof A first portion of the retractable handrail is mounted to each end of the trailing edge of the material handling assembly and a skid—on which a second portion of the retractable handrail is mounted—is positioned at each end of the trailing edge of the roof. A restraint is positioned between the first portion of the retractable handrail and the end frame in order to allow passage of workers, while also providing a fall restraint when in place.

The roller assembly includes a frame having opposing end members mounted on the terminal ends of two side walls. A plurality of rollers is journalled in parallel fashion between the side walls such that the roller assembly is free to roll along its longitudinal axis. Each end member defines an extended portion extending upwardly above the side walls. The side walls define a length greater than the width of the conveyor segment such that a conveyor segment is receivable between the end wall extended portions. The end wall extended portions define threaded openings for receiving cooperating bolts therein, the bolts being tightened to engage the opposing side walls of the conveyor segment. Once tightened, the relative positions of the conveyor segment and the roller assembly are fixed.

The side walls of the roller assembly in one embodiment terminate at an elevation above the bottom extent of the rollers. In an alternate embodiment, the side walls terminate below the bottom extent of the rollers in order to limit lateral movement of the roller assembly relative to the purlins, thereby preventing the conveyor segment mounted thereon from moving along its longitudinal axis.

BRIEF DESCRIPTION OF THE DRAWINGS

The above mentioned features of the invention will become more clearly understood from the following detailed description of the invention read together with the drawings in which.

BEST MODE FOR CARRRYING OUT THE INVENTION

Figure 1:
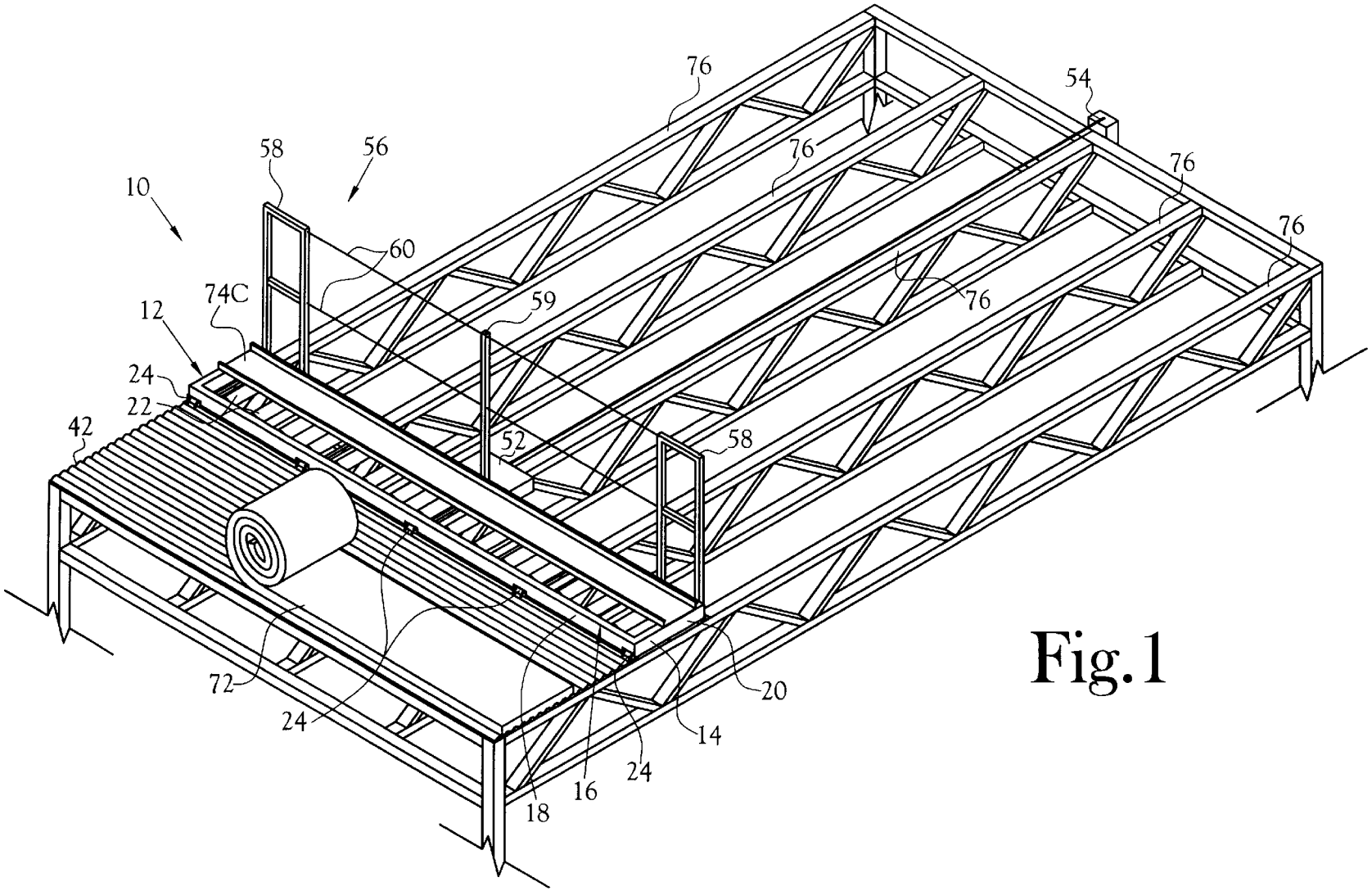
FIG. 1 is a perspective view of the metal roof installation system constructed in accordance with several features of the present invention showing an initial step in the installation of a metal roof system.

A metal roof installation system incorporating various features of the present invention is illustrated generally at 10 in the figures. The metal roof installation system, or system 10, is designed for installing a metal roof system 70 including an insulation layer 72 placed over a series of purlins 76 and under a metal deck 74 while also providing a means for preventing workers from falling through the insulation 72. The system provides a working deck 42 for supporting the insulation 72 prior to the securement of a section of metal decking 74, the working deck 42 being moved along the purlins 76 as the roof 70 is being installed, and particularly, the working deck 42 remaining under the insulation 72 until a roof panel 74 is in place and ready for securement to the purlins 76. Moreover, the system 10 of the present invention is provided with a material handling assembly 12 proximate the working deck 42 for quickly and efficiently moving roofing materials.

Referring to FIG. 1, the system 10 of the present invention is primarily comprised of a material handling assembly 12 and a working deck 42. The working deck 42 is mounted along its leading edge 44 to the material handling assembly 12. Each of the material handling assembly 12 and the working deck 42 of the preferred embodiment is configured to extend the entire length of the roof. Although not shown, for a roof defining two sloped portions, with a peak disposed at a point between two sides, each sloped portion is roofed independently of the other. Accordingly, in that situation, the system 10 of the present invention is configured to extend between an edge of the roof and the peak. Illustrated for use in association with the system 10 of the present invention is a handrail and warning line system 56 for placement generally around the periphery of the roof It will be understood that such safety precautions, as set forth in standard safety codes, such as OSHA, are used in association with the present invention for the protection of workers on the roof.

Figure 2:
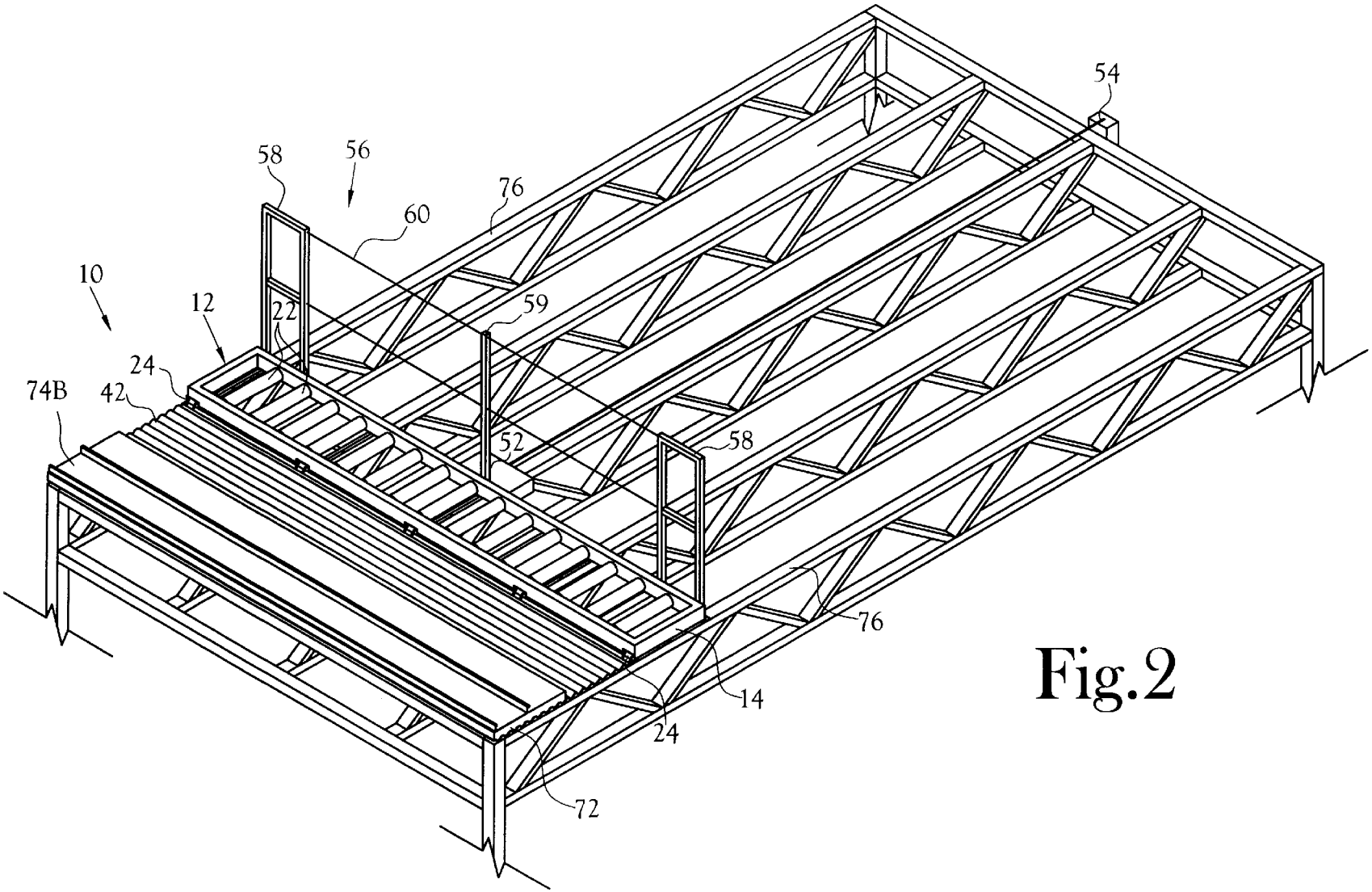
FIG. 2 is a perspective view of the metal roof installation system of FIG. 1 showing two roof panels in place for securement to the roof.
Figure 3:
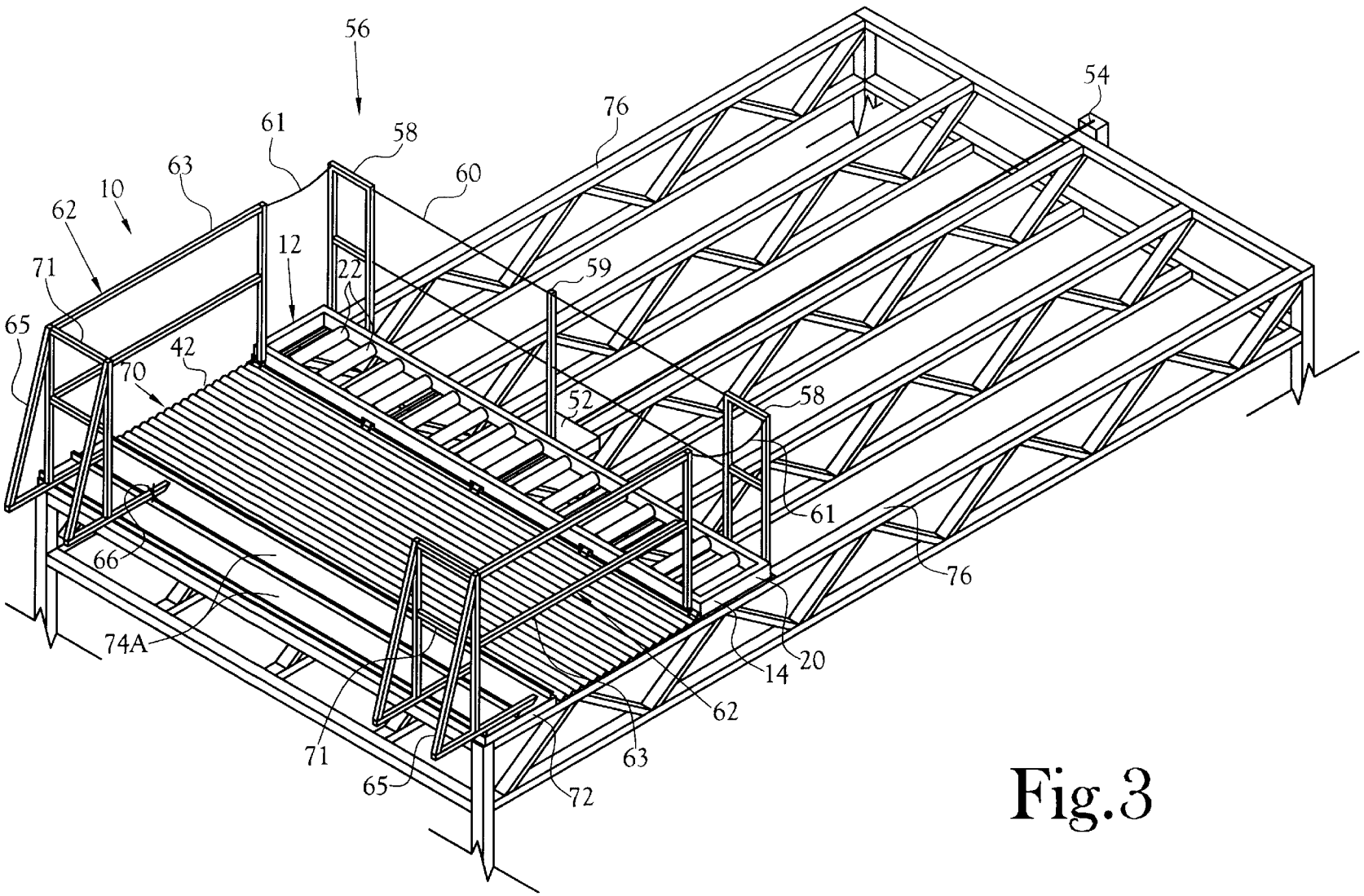
FIG. 3 is a perspective view of the metal roof installation system of FIG. 2 showing the two roof panels secured to the roof and the roof installation system having been moved to repeat the roof installation process.

FIGS. 1–3 illustrate briefly the process of installing a metal roof system 70 using the system 10 of the present invention. In FIG. 1, insulation 72 is being rolled along the entire length of the working deck 42. As will be disclosed below, the working deck 42 is designed to support the weight of any roofers that may be standing thereon. Because the insulation 72 that is exposed is being supported by the working deck 42, any roofer who steps on the insulation 72 is supported by the working deck 42. Also illustrated in FIG. 1 is at least one roof panel 74 disposed on the material handling assembly 12. FIG. 2 illustrates the next step of placing the roof panels 74 in place for securement to the roof In order to secure the roof panels 74, however, the working deck 42 must be moved out from under the insulation 72. Therefore, as illustrated in FIG. 3, the material handling assembly 12 and working deck 42 have been moved until the trailing edge 46 of the working deck 42 is positioned to allow the securement of the last roof panel 74 to the underlying purlins 76. After the first roof panel 74 is secured to the roof, each subsequent roof panel 74 in a conventional roof system 70 is secured to the previous roof panel 74 such that when the system 10 of the present invention is moved, the unsecured roof panel 74 will remain substantially in place while preparations are made for the securement thereof to the roof Thus, while the roof panel 74 is briefly unsecured to the roof and unsupported by the system 10 of the present invention, risk of accidental falls through the insulation 72 is minimal.

Figure 4:
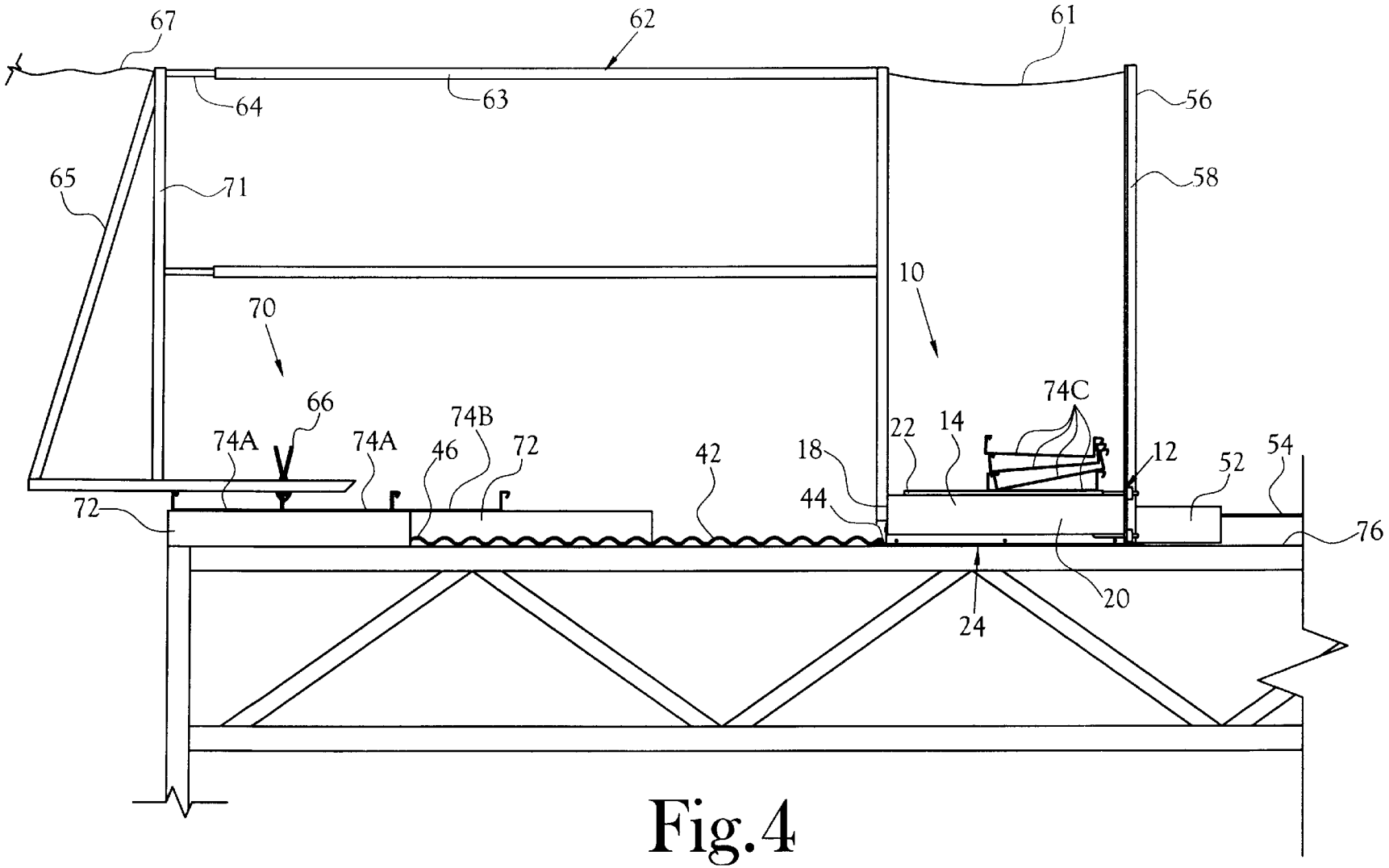
FIG. 4 is an end elevation view of the metal roof installation system illustrating the various components of the present invention.

Referring now to FIG. 4, which is an end elevation view of the system 10, the individual components of the present invention are more clearly illustrated and understood. The material handling assembly 12 includes at least one conveyor segment 14 positioned across the purlins 76. As better illustrated in FIG. 6, each conveyor segment 14 is comprised of a rectangular frame 16 in which is disposed a series of rollers 22. The rollers 22 are disposed in parallel fashion relative to each other and in a lateral direction with respect to the frame 16, such that as particular roofing materials or equipment are needed, they are fed onto the first conveyor segment 14, disposed at the edge of the roof, and then rolled up to a desired location on the roof. For example, as roof panels 74 are needed, they are loaded onto the material handling assembly 12, rolled to the desired location, and then simply pulled off of the material handling assembly 12 and placed over the insulation 72 that has been positioned.

A roller assembly 24 is secured to the conveyor segments 14 at each purlin 76 in order to accomplish lateral movement of the system 10 as the roof installation process progresses. In order to accomplish such lateral movement, at least one winch 52 is mounted to the material handling assembly 12 in a conventional manner. A winch cable 54 is extended and secured to the far end of the building. When it is desired to move the system 10 toward the far end of the building in order to secure a roof panel 74, each winch 52 is actuated to retract a length of the winch cable 54 equal to the width of the roof panel 74.

The working deck 42 is secured along a leading edge 44 to the trailing edge 18 of the material handling assembly 12 in a conventional manner. In the preferred embodiment, the working deck 42 is releasably secured to each roller assembly 24 using conventional bolts (not shown), as will be described in greater detail below. However, to this end, the leading edge 44 of the working deck 42 defines a series of through openings 48 provided for receiving a conventional bolt 50 also received by a through opening 34 defined in each roller assembly 24. In the preferred embodiment, the working deck 42 is fabricated from a corrugated metal such as to withstand the weight of several roofers, as well as materials and other equipment necessary to the installation of a metal roof system 70.

The handrail and warning line system 56 is mounted to the material handling assembly 12. Referring to FIGS. 1 and 2, in the illustrated embodiment, end frames 58 are mounted to the leading edge 19 of the material handling assembly 12. Intermediate supports 59 are likewise mounted to the leading edge 19 of the material handling assembly 12 at appropriate distances between the end frames 58. A safety cable 60 is tautly stretched between each of the end frames 58, and supported by each intermediate support 59. In the preferred embodiment, two such safety cables 60 are employed, with one at the top of the end frames 58 and intermediate supports 59, and one disposed at an intermediate height. It will be understood that, although not shown, the safety cables 60 illustrated may be replaced with handrail as well.

Referring now to FIG. 3, after a sufficient number of roof panels 74 have been secured to the purlins 76, a retractable handrail 62 and skid 65 assembly is employed on each end of the trailing edge of the roof 70. Specifically, a first portion 63 of the retractable handrail 62 is mounted to each end of the trailing edge 18 of the material handling assembly 12 and a skid 65—on which a second portion 64 of the retractable handrail 62 is mounted—is positioned at each end of the trailing edge of the roof 70. Once the retractable handrails 62 are positioned, a restraint 61, commonly referred to as a cattle gate, is positioned between the first portion 63 of the retractable handrail 62 and the end frame 58 in order to allow passage of workers, while also providing a fall restraint when in place. In the preferred embodiment the restraint 61 is a chain.

Figure 8:
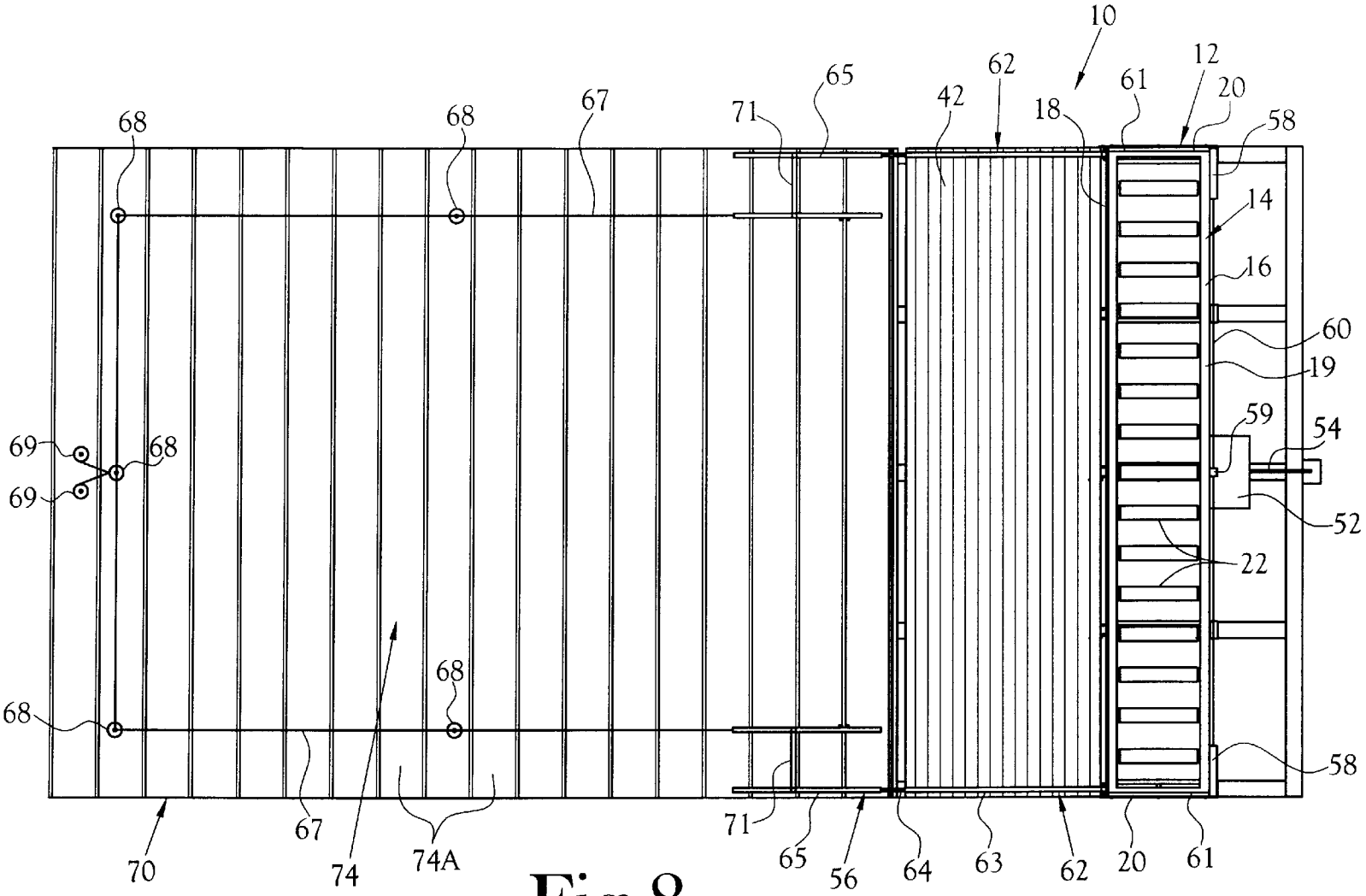
FIG. 8 illustrates a top plan view of the metal roof installation system of the present invention showing more clearly the handrail and warning line system used in association therewith.

The first and second retractable handrail portions 63,64 are telescopically received one within the other, such that as the system 10 is moved along the roof by actuation of the winches 52, the retractable handrail 62 is lengthened. The skid 65 is releasably secured to the roof such as by clamping the skid 65 to a seam formed by two roof panels 74 in a conventional manner. When the retractable handrail 62 is fully extended, prior to movement of the system 10, the skids 65 are released from the roof 70 and moved until the retractable handrail 62 is fully retracted. The skids 65 are then secured to the roof 70 at their new position. Each skid 65 includes a handrail portion 71 disposed parallel to the trailing edge of the roof 70 and defining a length at least equal to the minimum set forth by OSHA for the distance from the edge of a roof 70 at which a warning cable 67 must be disposed. Currently, such length is six feet (6'). To this extent, as best illustrated in FIG. 8, a warning cable 67 is tied to the terminal end of the skid handrail 71. The warning cable 67 is maintained on a spool 69 in the preferred embodiment and released as the skid 65 is moved along the roof 70. In the illustrated embodiment, a warning cable 67 is provided for each side of the handrail and warning line system 56. However, it will be understood that the warning cable 67 can be devised to employ a single warning cable 67. Intermediate supports 68 are provided for holding the warning cable 67 at a prescribed height above the roof 70. However, because the warning cable 67 is not to serve as a fall restraint, it is not maintained in a taut fashion. As the skids 65 are moved along the roof 70, additional intermediate supports 68 may be required.

FIG. 4 further illustrates the process as described generally above. Illustrated are two roof panels 74A secured in placed to the purlins 76. Also illustrated is a two roof panel 74B laid in place above insulation being supported by the working deck 42. Further illustrated are several roof panels 74C disposed upon the material handling assembly 12 and ready to be positioned above the insulation 72. In the illustrated stage, because the roof panel 74B is positioned over the insulation 72 and fastened to the roof panels 74A, the system 10 is ready to be moved to a distance equal to the width of the roof panel 74B such that it may be secured. The winch 52 is actuated to retract the winch cable 54, thus drawing the winch 52, and therefore the entire system 10, away from the completed portion of the roof When the edge of the insulation 72 is reached by the roof panels 74A, more insulation 72 is placed on the working deck 42 next to the insulation 72 illustrated, and the roof panels 74C will be ready to be placed.

Figure 5:
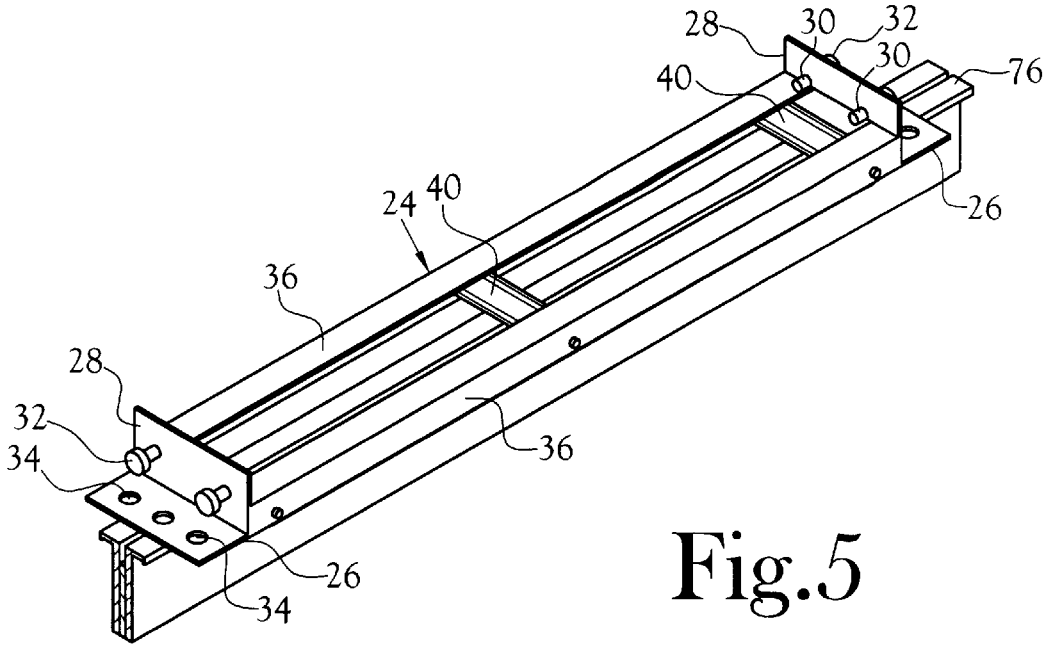
FIG. 5 is a perspective view of the roller assembly used in association with the present invention.

FIG. 5 illustrates a perspective view of the roller assembly 24 of the present invention. The roller assembly 24 includes a frame having opposing end members 26 mounted on the terminal ends of two side walls 36. A plurality of rollers 40 is journalled in parallel fashion between the side walls 36 such that the roller assembly 24 is free to roll along its longitudinal axis. Each end member 26 defines an extended portion 28 extending upwardly above the side walls 36. The side walls 36 define a length greater than the width of the conveyor segment 14 such that a conveyor segment 14 is receivable between the end wall extended portions 28, the conveyor segment 14 resting on the roller assembly side walls 36 when so received. The end wall extended portions 28 define threaded openings 30 for receiving cooperating bolts 32 therein, the bolts 32 being tightened to engage the opposing side walls of the conveyor segment 14. Once tightened, the relative positions of the conveyor segment 14 and the roller assembly 24 are fixed. It will be understood that other conventional devices may be used to mount the roller assembly 24 to the material handling assembly 12.

Figure 7:
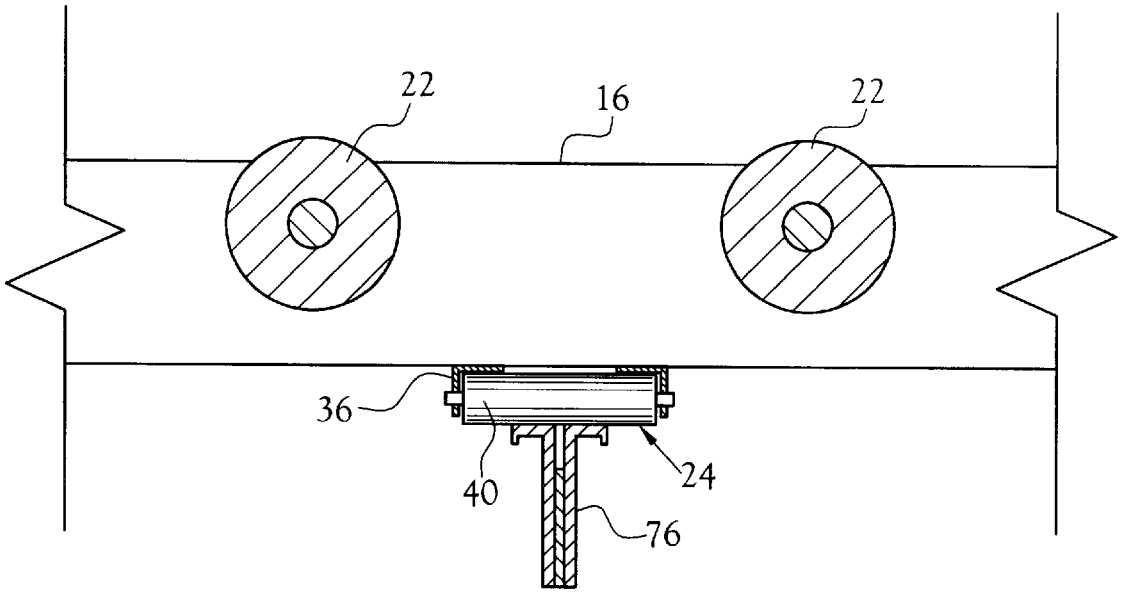
FIG. 7 illustrates, in section, a side elevation view of the roller assembly and conveyor segment of the present invention.
Figure 7A:
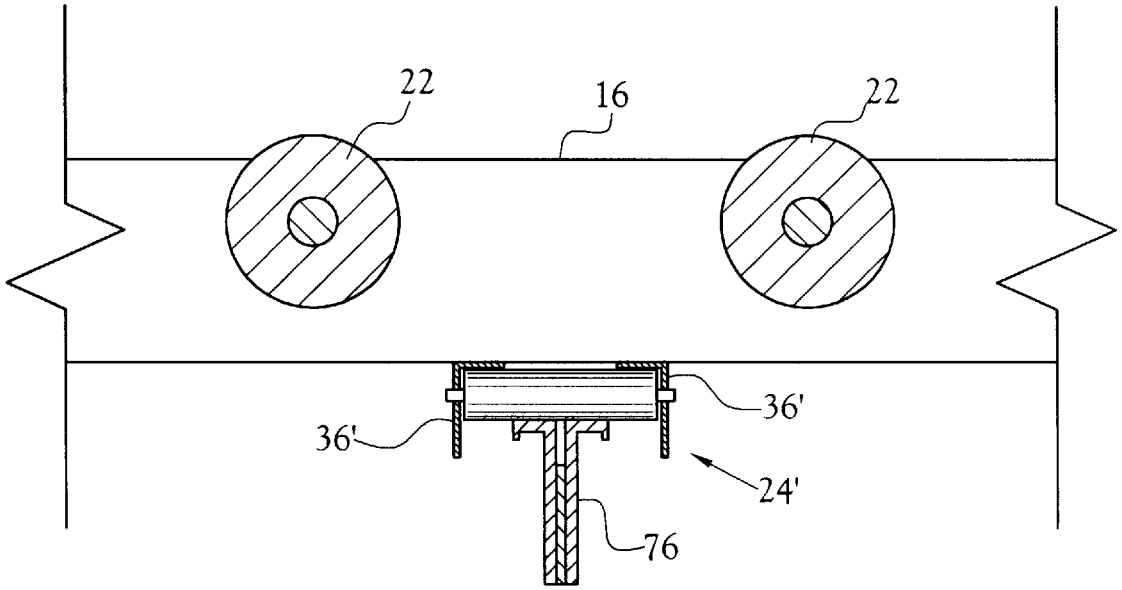
FIG. 7A illustrates, in section, a side elevation view of an alternate embodiment of the roller assembly and conveyor segment of the present invention.

As illustrated in FIG. 7, the side walls 36 of the roller assembly 24 in one embodiment terminate at an elevation above the bottom extent of the rollers 40. In this embodiment, the length of the rollers 40 relative to the width of the purlins 76 is not critical, and the roller assembly 24 is thus free to move laterally with respect to the purlins 76. An alternate embodiment as illustrated in FIG. 7A shows the side walls 36' as terminating below the bottom extent of the rollers 40. In this embodiment, the rollers 40 must define a length greater than the width of the purlin 76 such that the purlin 76 is received between the two side walls 36'. In this embodiment, lateral movement of the roller assembly 24 is limited, thereby preventing the conveyor segment 14 mounted thereon from moving along its longitudinal axis. In the preferred embodiment of the present invention, each of the roller assemblies 24,24' are used in combination with each other.

Figure 6:
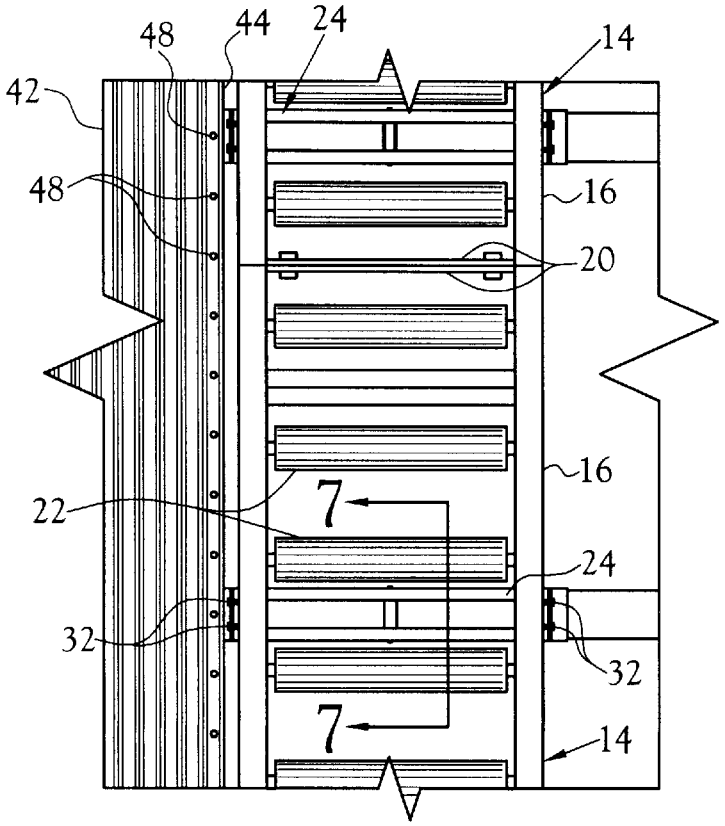
FIG. 6 is a top plan view of a portion of the present invention illustrating the fastening of two conveyor segments thereof.

Illustrated in FIG. 6 is a top plan view of two conveyor segments 14 secured in an end to end fashion. Each conveyor segment 14 defines opposing end walls 20 which, when two conveyor segments 14 are placed in an end to end fashion, are secured in a conventional manner such as by bolting. It will be understood that other conventional devices for releasably securing the conveyor segments 14 may be used as well.

In order to use the system 10 of the present invention, a conveyor segment 14 is placed across a plurality of purlins 76, with a lower end of the conveyor segment 14 disposed at the edge of the roof At each purlin 76, a roller assembly 24 is positioned under and mounted to the conveyor segment 14. At least one roller assembly 24' is used in the preferred embodiment to prevent the conveyor segment 14 from sliding across the purlins 76. A segment of a working deck 42 is then mounted to at least two of the roller assemblies 24. Subsequent conveyer segments 14 are mounted in an end to end fashion to define a continuous conveyor substantially equal to the length of the roof Also mounted to the conveyor segments 14 are the safety cord 56 and the winches 52. For each winch 52, the winch cable 54 is withdrawn and secured at a location proximate the far end of the roof After the system 10 has been installed, the first roll of insulation 72 is placed on the working deck 42, and upon which is placed the first roof panels 74. Thereafter, the roofing process continues as heretofore described.

From the foregoing description, it will be recognized by those skilled in the art that a metal roof installation system offering advantages over the prior art has been provided. Specifically, the system is provided for installing a metal roof system including an insulation layer placed over a series of purlins and under a metal deck while also providing a means for preventing workers from falling through the insulation. The system provides a working deck for supporting the insulation prior to the securement of a section of metal decking, the working deck being moved along the purlins as the roof is being installed, and particularly, the working deck remaining under the insulation until a roof panel is in place and ready for securement to the purlins. Moreover, the system of the present invention is provided with a material handling device proxinate the working deck for quickly and efficiently moving roofing materials.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. A system for installing a metal roof system including an insulation layer placed over a series of purlins and under a metal deck and for preventing workers from falling through the insulation, said system comprising:

a material handling assembly adapted to extend along a length of the roof and across and to be supported on the series of purlin, said material handling assembly including at least one conveyor segment for facilitating movement of materials along said material handling assembly in an orthogonal direction relative to the purlins;

at least one roller assembly secured to said material handling assembly for assisting lateral movement of said system along the purlins;

at least one winch mounted to said material handling assembly for accomplishing lateral movement of said system along the purlins, said winch including a winch cable adapted to be extended and to be secured to a far end of the roof;

a working deck releasably secured to each said roller assembly along one side of said material handling assembly, said working deck being configured to support a load placed thereon, and specifically to prevent objects and persons from falling through an insulation layer supported thereby.

2. The system of claim 1 further comprising a safety device carried by said material handling assembly to serve as a fall protector.

3. The system of claim 1 wherein said at least one conveyor segment includes a rectangular frame and a plurality of rollers disposed in said frame, said plurality of rollers being disposed in parallel fashion relative to each other and in a lateral direction with respect to said frame.

4. The system of claim 3 wherein said frame of said at least one conveyor segment defines opposing end walls, a first end wall of one said conveyor segment being releasably securable to a second end wall of another said conveyor segment in an end to end fashion to define a continuous conveyor.

5. The system of claim 1 wherein said at least one roller assembly includes a frame, a plurality of rollers, and a fastening device, said frame having opposing end members mounted on first and second ends defined by a pair of side walls, said plurality of rollers being journalled in parallel fashion between said side walls such that said roller assembly is free to roll along a longitudinal axis thereof.

6. The system of claim 5 wherein said fastening device includes an extending portion defined by each of said end members and at least one fastener carried by said extended portion for engaging said at least one conveyor segment, said extended portion extending upwardly above said side walls, said side walls defining a length greater than a width of said at least one conveyor segment such that said conveyor segment is receivable between said end wall extended portions.

7. The system of claim 5 wherein a lower edge of each of said roller assembly side walls terminates at an elevation above a bottom extent of said rollers.

8. The system of claim 5 wherein a lower edge of each of said roller assembly side walls terminates at an elevation below a bottom extent of said rollers.

9. A system for installing a metal roof system including an insulation layer placed over a series of purlins and under a metal deck and for preventing workers from falling through the insulation, said system comprising:

a material handling assembly adapted to extend along a length of the roof and across and to be supported on the series of purlins, said material handling assembly including at least one conveyor segment for facilitating movement of materials along said material handling assembly in an orthogonal direction relative to the purlins, said at least one conveyor segment including a rectangular frame and a plurality of rollers disposed in said frame, said plurality of rollers being disposed in parallel fashion relative to each other and in a lateral direction with respect to said frame, said frame of said at least one conveyor segment being configured to be releasably securable to another said at least one conveyor segment in an end to end fashion to define a continuous conveyor;

at least one roller assembly secured to said material handling assembly for assisting lateral movement of said system along the purlins, said at least one roller assembly including a frame, a plurality of rollers, and a fastening device, said frame having opposing end members mounted on first and second ends defined by a pair of side walls, said plurality of rollers being journalled in parallel fashion between said side walls such that said roller assembly is free to roll along a longitudinal axis thereof;

at least one winch mounted to said material handling assembly for accomplishing lateral movement of said system along the purlins, said winch including a winch cable adapted to be extended and to be secured to a far end of the roof;

a working deck releasably secured to each said roller assembly along one side of said material handling assembly, said working deck being configured to support a load placed thereon, and specifically to prevent objects and persons from falling through an insulation layer supported thereby.

10. The system of claim 9 wherein said fastening device includes an extending portion defined by each of said end members and at least one fastener carried by said extended portion for engaging said at least one conveyor segment, said extended portion extending upwardly above said side walls, said side walls defining a length greater than a width of said at least one conveyor segment such that said conveyor segment is receivable between said end wall extended portions.

11. The system of claim 9 wherein a lower edge of each of said roller assembly side walls terminates at an elevation above a bottom extent of said rollers.

12. The system of claim 9 wherein a lower edge of each of said roller assembly side walls terminates at an elevation below a bottom extent of said rollers.

13. The system of claim 9 further comprising a safety device carried by said material handling assembly to serve as a fall protector.

14. A method for installing a metal roof system including an insulation layer placed over a series of purlins and under a metal deck and for preventing workers from falling through the insulation, said method comprising the steps of:

(a) placing a material handling assembly along a length of a roof and across and supported on a series of purlins, said material handling assembly including at least one conveyor segment;

(b) mounting a roller assembly under said at least one conveyor segment and in engagement with each purlin, said roller assembly for assisting lateral movement of said material handling assembly along the purlins;

(c) mounting at least one winch to said material handling assembly for accomplishing lateral movement of said system along the purlins, said winch including a winch cable extended and secured to a far end of the roof;

(d) mounting a working deck in a releasable manner to each said roller assembly along one side of said material handling assembly, said working deck being configured to support a load placed thereon, and specifically to prevent objects and persons from falling through in insulation layer supported thereby;

(e) placing insulation over said working deck;

(f) placing a first roof panel over said insulation;

(g) engaging said winch to move said material handling assembly and said working deck until said working deck is removed from under the first roof panel;

(h) fastening the first roof panel to the purlins;

(i) placing insulation over said working deck;

(j) placing a subsequent roof panel over said insulation;

(k) fastening the subsequent roof panel to a roof panel previously fastened to the roof;

(l) engaging said winch to move said material handling assembly and said working deck until said working deck is removed from under the subsequent roof panel;

(m) fastening the subsequent roof panel to the purlins; and (n) repeating said step of (i) placing insulation over said working deck through said step of (m) fastening the subsequent roof panel to the purlins until the metal roof system is installed.

15. The method of claim 14, in said step of placing a material handling assembly, wherein said at least one conveyor segment includes a rectangular frame and a plurality of rollers disposed in said frame, said plurality of rollers being disposed in parallel fashion relative to each other and in a lateral direction with respect to said frame.

16. The system of claim 15 wherein said frame of said at least one conveyor segment defines opposing end walls, a first end wall of one said conveyor segment being releasably securable to a second end wall of another said conveyor segment in an end to end fashion to define a continuous conveyor.

17. The system of claim 14, in said step of mounting a roller assembly, wherein said at least one roller assembly includes a frame, a plurality of rollers, and a fastening device, said frame having opposing end members mounted on first and second ends defined by a pair of side walls, said plurality of rollers being journalled in parallel fashion between said side walls such that said roller assembly is free to roll along a longitudinal axis thereof.

18. The system of claim 17 wherein said fastening device includes an extending portion defined by each of said end members and at least one fastener carried by said extended portion for engaging said at least one conveyor segment, said extended portion extending upwardly above said side walls, said side walls defining a length greater than a width of said at least one conveyor segment such that said conveyor segment is receivable between said end wall extended portions.

19. The system of claim 17 wherein a lower edge of each of said roller assembly side walls terminates at an elevation above a bottom extent of said rollers.

20. The system of claim 17 wherein a lower edge of each of said roller assembly side walls termates at an elevation below a bottom extent of said rollers.

* * * * *